US007009373B1

(12) United States Patent
Garavan

(10) Patent No.: US 7,009,373 B1
(45) Date of Patent: Mar. 7, 2006

(54) SWITCHED CAPACITOR BANDGAP REFERENCE CIRCUIT

(75) Inventor: Patrick J. Garavan, Limerick (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 10/823,242

(22) Filed: Apr. 13, 2004

(51) Int. Cl.
*G05F 3/16* (2006.01)
*G05F 3/20* (2006.01)

(52) U.S. Cl. ..... 323/313; 323/315; 327/543; 327/337

(58) Field of Classification Search ..... 323/313, 323/315; 327/543, 337
See application file for complete search history.

(56) References Cited

U.S. PATENT DOCUMENTS 5,059,820 A 10/1991 Westwick
5,352,972 A * 10/1994 Pernici et al. ..... 323/313
5,352,973 A 10/1994 Audy
5,821,807 A * 10/1998 Brooks ..... 327/540
5,867,012 A 2/1999 Tuthill
6,060,874 A * 5/2000 Doorenbos ..... 323/316
6,784,725 B1 * 8/2004 Wadhwa et al. ..... 327/543

OTHER PUBLICATIONS

Meijer, G.C.M., et al, "A New Curvature-Corrected Bandgap Reference", IEEE Journal of Solid-State Circuits, vol. SC-17, No. 6, Dec. 1982.
Razavi, B., "CMOS Processing Technology", Chap. 17—*Design of Analog CMOS Integrated Circuits,* McGraw Hill, International Edition 2001.

* cited by examiner

*Primary Examiner*—Bao Q. Vu
(74) *Attorney, Agent, or Firm*—Wolf, Greenfield & Sacks, P.C.

(57) ABSTRACT

A circuit is provided which is adapted to compensate for the inherent parasitic capacitance which is implicit in switched capacitor circuits. By shielding the parasitic capacitance to a common node of the circuit and then connecting this shield to a voltage source that tracks the voltage change at the input to an amplifier, the present invention provides a bootstrapping effect that enables a minimization of the effect of the parasitic capacitance. The invention also provides a circuit that is adapted to compensate for curvature in the output of a switched capacitor bandgap reference.

36 Claims, 7 Drawing Sheets

SWITCHED CAPACITOR BANDGAP REFERENCE CIRCUIT

FIELD OF THE INVENTION

The present invention relates to bandgap reference circuits and in particular to a switched bandgap reference circuit. The invention more particularly relates to a switched bandgap reference circuit that minimizes the variation in the circuit output arising from parasitic capacitance effects. A bandgap circuit including a curvature correction scheme is also included within the field of the invention.

BACKGROUND OF THE INVENTION

Bandgap reference circuits are well known in the art and are used to provide a stable voltage output that is independent of temperature fluctuations. Bandgap reference circuits may be provided in a continuous and switched configuration, the two differing in that the continuous arrangements are circuits not including switching arrangements. An example of a switched arrangement is U.S. Pat. No. 5,059,820 assigned to Motorola which by time multiplexing two or more current sources to source current to a single bipolar transistor claims to achieve a more stable base emitter voltage as an input for a switched capacitor bandgap reference circuit. A further example of such known circuits is provided in U.S. Pat. No. 5,867,012 of Michael Tuthill, co-assigned to the assignees of the present invention, the content of which is incorporated herein by reference.

Referring to FIG. 1, which is equivalent to FIG. 4 of the '012 patent but explicitly details the inherent parasitic capacitances (Cp) present in the circuit, one of the key advantages of this circuit is that it reduces the value of the capacitance C1 by a factor of 2× by using a compounded switching scheme. This is achieved by using two bipolar devices, thereby doubling the difference in base emitter voltage, ΔVeb, generated. The switching scheme can be summarised as operating in two different phases (ph1 and ph2), and in each phase the current applied to the transistors Q1 and Q2 differs:

during a first phase, ph1: I(Q2)=I and I(Q1)=N*I and during a second phase: ph2, I(Q2)=N*I and I(Q1)=I.

The effect of this switching is that the voltage at the negative input of the op-amp changes between the clock phases ph1 and ph2 by a value approximately equal to (kT/q)(ln(N)) where k is Boltzmann's constant, T is the absolute temperature in Kelvin, q is the charge on an electron and N is the current density ratio. This switching introduces a sensitivity to the parasitic capacitance (Cp) on the negative input node of the amplifier. The sensitivity introduces an error into the output of the circuit and makes the circuit less tolerant to manufacturing variations.

To understand the effect of the parasitic capacitance on the output of the circuit of FIG. 1, the following analysis can be used in both clock phases to determine the output voltage (Vout).

$$\Delta Veb1 = Veb1(NI) - Veb1(I) = [(kT)/q]ln(N) \quad (1)$$

and $$\Delta Veb2 = Veb2(NI) - Veb2(I) = [(kT)/q]ln(N) \quad (2)$$

$$Vout = Veb2(NI) + [C1/C2]*[\Delta Veb1 + \Delta Veb2] + [Cp/C2]*\Delta Veb2 \quad (3)$$

Assuming that ΔVeb1=ΔVeb2=ΔVeb then to a first order approximation, $$Vout = Veb2(NI) + \Delta Veb*[2*C1 + Cp]/C2 \quad (4)$$

The last term in equation 4 is a parasitic induced error term arising from the capacitance associated with the parasitic capacitor Cp. While C1 can be reduced somewhat to account for Cp, the variation arising from manufacturing processes cannot easily be accounted for. There is, therefore, a need to provide a switched capacitor bandgap circuit that is adapted to compensate for the parasitic capacitance inherent in such circuits.

A further problem that arises in bandgap circuits arises from a curvature in the output voltage verses temperature. As can be seen from Equation 4, the output of a bandgap circuit is formed from the sum of two components: the first being a proportional to absolute temperature (PTAT) component arising from the difference in base emitter voltages of two bipolar transistors operating at different current densities and the second attributable to the base emitter voltage of a bipolar transistor. This latter component contributes the curvature and arises from the transistor q2 in FIG. 1. Although not shown in equation 4, as well as the linear relationship provided by the first term of equation 4, the base emitter voltage also exhibits a second order non-linear temperature relationship term, which is commonly called temperature curvature. This non-linear term is commonly represented by the term K1.TlnT, where K1 is a constant and T is the absolute temperature. In order to provide a voltage reference that is entirely temperature stable over the range, it is preferable that this TlnT term should be compensated. It is well known that by reducing the curvature that it is possible to improve the performance of the bandgap reference, and it is desirable to achieve this reduction in curvature contribution without significantly redesigning the circuit of FIG. 1. In addition it would be preferable to provide a solution that is both area efficient and has low power requirements. Typically, it is known to compensate for the curvature or bow effect by introducing a complementary term of opposite sign to the TlnT term so as to effectively cancel out the effect of the TlnT term. U.S. Pat. No. 5,352,973 of Audy details examples of known curvature correction schemes, as does "A new curvature-corrected bandgap reference" *IEEE JSSC*, vol. SC-17, No. 6, December 1982, the contents of both being incorporated by reference. Although these circuits are applicable and useful for the environments in which they are described it would be useful to have an implementation specifically suitable for the switched capacitor configuration of FIG. 1.

There is therefore a need for a circuit that is adapted to compensate for the inherent parasitic capacitance that is present in switched capacitor bandgap reference circuits. There is a further need to provide a curvature correction scheme that is both easy to implement has low power requirement and does not occupy much area on a die.

SUMMARY OF THE INVENTION

These and other needs are addressed by circuits in accordance with the present invention. In a first embodiment, a circuit is provided which is adapted to compensate for the inherent parasitic capacitance which is implicit in switched capacitor circuits. By shielding the parasitic capacitance to a common node of the circuit and then connecting this shield to a voltage source that tracks the voltage change at the input to an amplifier, the present invention provides a bootstrapping effect that enables a minimisation of the effect of the parasitic capacitance. The invention also provides a circuit that is adapted to compensate for curvature in the output of a switched capacitor bandgap reference. By utilising a bipolar transistor stack, the present invention provides a complimentary TlnT voltage term, which is superimposed with the PTAT voltage at the output of the circuit, thereby compensating for the bow effect that is present at the output.

Accordingly, a first embodiment of the invention provides a switched capacitor bandgap reference circuit comprising: a first transistor adapted to operate at a first current density so as to provide a first transistor output, second transistor adapted to operate at a second current density so as to provide a second transistor output, a switched capacitor amplifier including a capacitor network, the amplifier providing an output based on the difference between the first and second transistor outputs, a capacitor shield adapted to shield said capacitor network, and a voltage driving circuit coupled to said capacitor shield, the voltage driving circuit being adapted to drive said shield to the voltage of one of the transistor outputs.

The capacitor network desirably includes at least two capacitors, a first capacitor coupled to an inverting input of the amplifier and a second capacitor provided in a feedback loop between the output of the amplifier and the inverting input. The first and second capacitors are provided with an interconnect therebetween, and the circuit preferably additionally comprises an interconnect shield adapted to shield said interconnect. The interconnect shield is preferably also coupled to a voltage driving circuit, the voltage driving circuit being adapted to drive said shield to the voltage of one of the transistor outputs. The driving circuit coupled to the interconnect shield and the driving circuit coupled to the capacitor shield are normally the same circuit. Similarly, the capacitor shield and the interconnect shield are normally provided by the same shield. Such sharing of both driving circuit and shields serves to ease the design of such circuits.

The capacitors are typically provided by at least two layers in a multi-layer structure, the at least two layers being formed one above the other and being separated from one another, the capacitor shield being formed as a layer above the upper layer of the capacitor structure. The interconnect may also be provided by a layer within a multi-layer structure. The interconnect layer may be provided in a sandwich arrangement, being shielded above and below by layers of the multi-layer structure.

Two or more layers of the multiplayer circuit may be coupled to one another, thereby being provided at the same potential, these layers providing at least one of the capacitor shield or interconnect shield.

The circuit may further include a switching device coupled to the second capacitor and provided in the feedback loop between the amplifier output and its inverting input. In such an embodiment, an interconnect between the second capacitor and the switching device may also be shielded with the interconnect shield.

When formed using a multi-layer structure, at least one of the layers in the multi-layer structure is desirably a metal layer. Alternative embodiments may provide for at least one of the layers in the multi-layer structure to be formed from polysilicon material.

The amplifier output of the circuit is desirably a combination of a proportional to absolute temperature (PTAT) voltage provided by the difference in base emitter voltages between the two transistors and a voltage provided by the base emitter voltage of one of the transistors. The capacitor network typically includes a first capacitor coupled to the negative input of the amplifier and a second capacitor provided in a feedback loop between the output of the amplifier and the negative input of the capacitor and the PTAT voltage is scaled by a value proportional to the ratio of the values of the first and second capacitors.

The base emitter voltage of one of the transistors includes a second order TlnT term, the TlnT term contributing a curvature effect at the output of the amplifier and in certain embodiments of the invention the circuit further includes curvature correction components, the curvature correction components adapted to provide a complimentary TlnT voltage term which is superimposed at the output of the amplifier so as to compensate for any bow effect arising from the second order TlnT term of the base emitter voltage of one of the transistors. Such curvature correction components may be coupled to the inverting input of the amplifier.

When including curvature correction components, a third capacitor may be provided, the third capacitor being provided in the path between the inverting input of the amplifier and the curvature correction components.

As with the above mentioned embodiments, where a third capacitor is provided an interconnect between the third capacitor and the inverting input may also be shielded, the shield being coupled to a voltage driving circuit, the voltage driving circuit being adapted to drive said shield to the voltage of one of the transistor outputs.

Preferably, the curvature correction components may be switchably coupled to the amplifier. This enables a configuration of the circuit to include or omit the feature of curvature correction.

The voltage driving circuit of the invention typically includes a transistor configured as a voltage follower, the transistor being coupled to a current source and ground or reference potential, the gate of the transistor being coupled to one of the transistors operating at different current densities.

The invention also provides in certain embodiments a switched capacitor bandgap reference circuit including an amplifier having a first capacitor coupled to its inverting input and a second capacitor provided in a feedback loop from the output to the inverting input, each of the capacitors being formed from a stack arrangement, the stack including first and second layers located one above the other and having a shield located thereabove, the circuit additionally including a first and a second bipolar transistor, the transistors adapted to operate at different current densities and being switchably coupled to the inverting and non-inverting inputs of the amplifier such that, in use, a switching operation effects the generation of a difference in base emitter voltage, $\Delta$Veb, between the two transistors which when coupled to a base emitter voltage of the first transistor generates at the output of the amplifier a voltage reference, and wherein a voltage follower is additionally provided, the voltage follower being coupled to the shield of the capacitors and being further adapted to track voltage changes at the amplifier input, thereby bootstrapping the shield of the capacitors to the first transistor and minimizing the effect of parasitic capacitances.

The voltage follower is typically a high impedance device and usually is provided as a MOSFET device.

In further embodiments of the invention a switched capacitor bandgap reference circuit is provided, the circuit including an amplifier having a first capacitor coupled to its inverting input and a second capacitor provided in a feedback loop from the output to the inverting input, the circuit additionally including a first and a second bipolar transistor, the transistors adapted to operate at different current densities and being switchably coupled to the inverting and non-inverting inputs of the amplifier such that, in use, a switching operation effects the generation of a difference in base emitter voltage, $\Delta$Veb, between the two transistors which when coupled to a base emitter voltage of the first transistor generates at the output of the amplifier a voltage reference, the voltage reference being a combination of a proportional to absolute temperature (PTAT) voltage provided by the difference in base emitter voltages between the two transistors and a voltage provided by the base emitter voltage of the first transistor, the voltage provided by the base emitter voltage of the first transistor having first and second order contributions and wherein the circuit additionally comprises curvature correction components, the curvature correction components being coupled to the inverting input of the amplifier and adapted to provide a complimentary voltage to the second order contribution of the first transistor so as to compensate for any bow effect arising from the second order contribution.

The ratio of the values of the first and second capacitors may be used to determine a scaling of the PTAT voltage.

In certain embodiments curvature correction components may be coupled to the inverting input via a third capacitor, and if coupled they may alternatively be switchably coupled to the inverting input.

These and other features of the present invention will be better understood with reference to the following drawings.

DETAILED DESCRIPTION OF THE DRAWINGS

Figure 1:
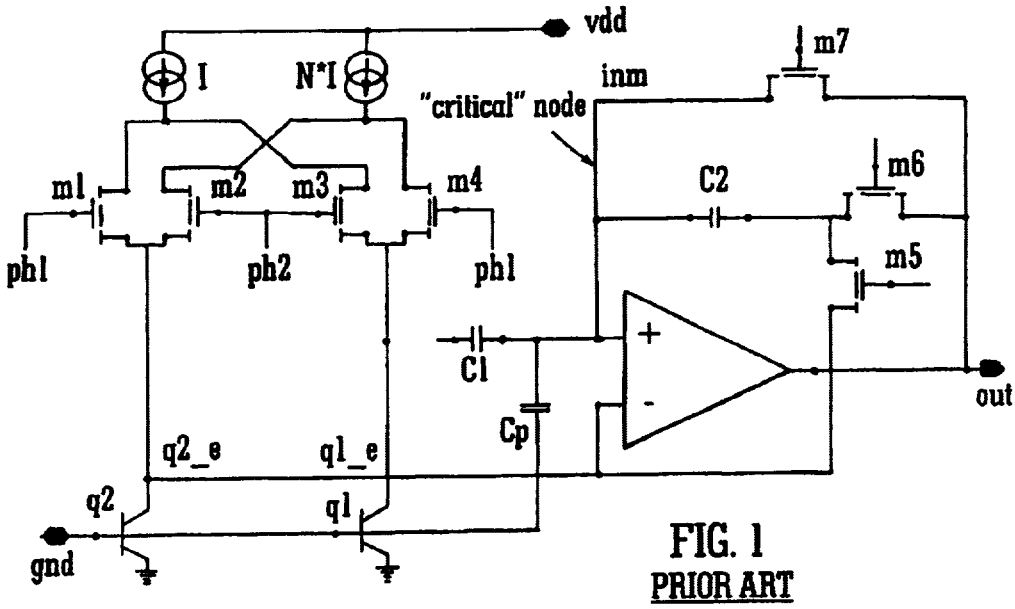
FIG. 1 PRIOR ART
FIG. 1 is a schematic of a switched capacitor circuit in accordance with the prior art.

FIG. 1 has been described with reference to the prior art.

Figure 2A:
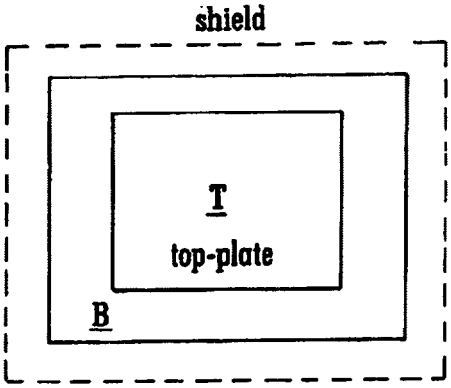
FIG. 2A PRIOR ART
FIG. 2*a* is a top view of a practical implementation of a capacitor as implemented in an integrated circuit.
Figure 2B:
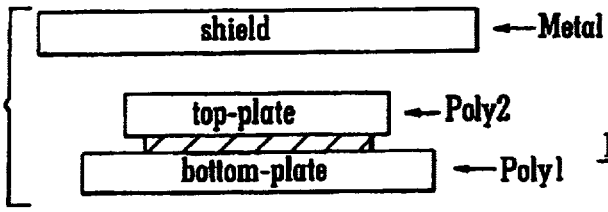
FIG. 2B PRIOR ART
FIG. 2*b* is a cross-section of the structure of FIG. 2*a*.

FIGS. 2*a* and 2*b* show an example of how a capacitor of FIG. 1 would be implemented traditionally in a multi-layer structure. Each of the layers are formed from either a polysilicon or metal layer, the number of which and arrangement relative to one another being determined by the application of the circuit The layout shown is typically how either C1 or C2 of FIG. 1 would have been formed, and more information can be found in Chapter 17 of "Design of Analog CMOS Integrated Circuits" International Edition 2001 as published by McGraw Hill. If we firstly address the problem of the contribution of the inherent parasitic capacitance, it is useful to understand how this arises. Each of the capacitors C1/C2 are provided by a bottom-plate of poly1 material (B) and a top-plate of poly2 material (T). The terminals of the capacitor are the connections to these plates. The top-plate gets connected to the negative input to the amplifier. Using conventional techniques, up to 7 or 8 metal layers can be provided on top of the top poly layer.

The bulk of the parasitic capacitance (Cp) arises from an interaction between the top-plate and surrounding surfaces. To minimize the variability of this capacitance from the effects of packaging, etc., it is common practice to use a metal "shield" to cover the capacitor structure, and to connect this shield to ground. While this solution gives a more predictable amount of parasitic capacitance, it does, however, increase the size of the parasitic. The other main additional parasitic contributions of this circuit are due to the interconnect layer which connects C1 to C2 to the MOS device M7 and to the op-amp negative input.

Figure 3:
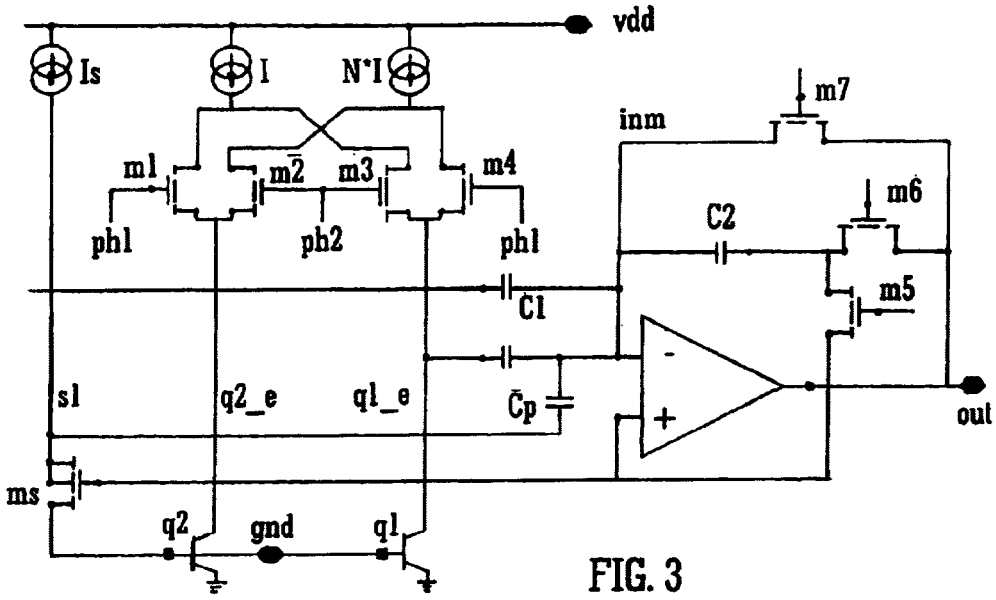
FIG. 3 is a circuit in accordance with a first embodiment of the present invention.

The present invention addresses this problem by using an arrangement as provided in FIG. 3. FIG. 3 is the same as FIG. 1 bar the inclusion of a source follower arrangement including a current source, Is, coupled to a MOS device MS. The source of MS is coupled to the negative input of the amplifier and the gate is coupled to the emitter of q2 and the positive input of the amplifier. The drain is coupled to ground. It will be appreciated that rather than connecting the "shield" to ground (as was discussed as with reference to FIG. 2), it is now connected to a voltage that is bootstrapped from the emitter of q2 using the source follower MS and Is. This has the effect of significantly minimizing the effect of the parasitic capacitance. In operation, the "shield" node of both the metal over the capacitors and the interconnect shield are tied to the output of the source follower, node s1. When the voltage on the emitter of transistor q2 (q2_e) changes, such change arising from the normal switching activity of the switched capacitor bandgap reference that is FIG. 3, the voltage on node s1 tracks this change with an accuracy that is determined by the follower. Any offset in the follower will be cancelled due to the auto-zero process of the switching. The error term of equation 4 now becomes:

$$[Cp/C\mathbf{2}]*(\Delta Veb\mathbf{2}-\Delta Vs1) \tag{5}$$

where ΔVs1 is the change in voltage at the source follower output node s1. The source follower should be chosen as a high impedance device so that DC current is not taken by it from transistor q2. Therefore, it is desirable that it is provided by a MOSFET device. The voltage follower and constant current source together provide a voltage driving circuit which is adapted to drive said shield to the voltage of the emitter of transistor q2.

Figure 4:
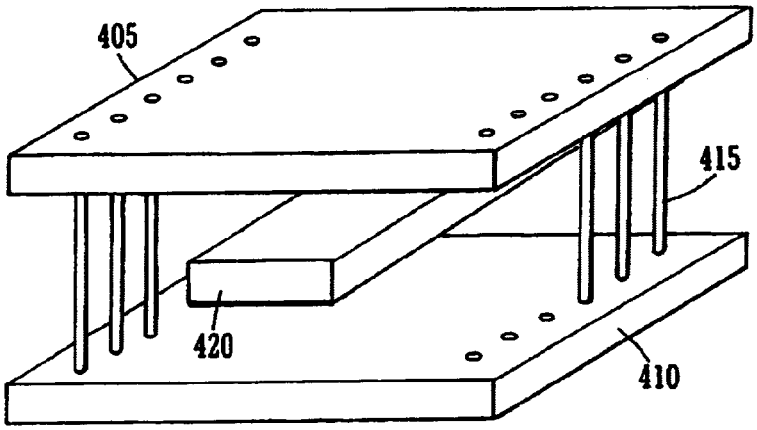
FIG. 4 is a side view of an interconnect arrangement.

As shown in FIG. 4, where top 405 and bottom shields 410 are connected together using vias 415 or contacts, the interconnect connection to the negative input of the amplifier is shielded as well. The signal carrying layer 420 is sandwiched between two additional layers that connect together at node s1 of FIG. 3. Using the multiple metal layers available, one can also couple each of the interconnects. This achieves the introduction of a floating leg but although it will be appreciated that these layers can be connected as convenient, if the interconnects are also to be coupled at least three interconnect layers must be available. For example these could be met1-met2-met3 or poly1-met1-met2 etc., the only caveat being that the middle layer of the three layers should be connected in each case to the negative input of the amplifier. Typically, the routing layer needs to be maintained and in a three layer metal process, the poly1 layer can be used as the routing layer. It will be appreciated that a poly layer is normally not used as a routing layer, as the properties of metal layers are better suited for routing signals.

Figure 5A:
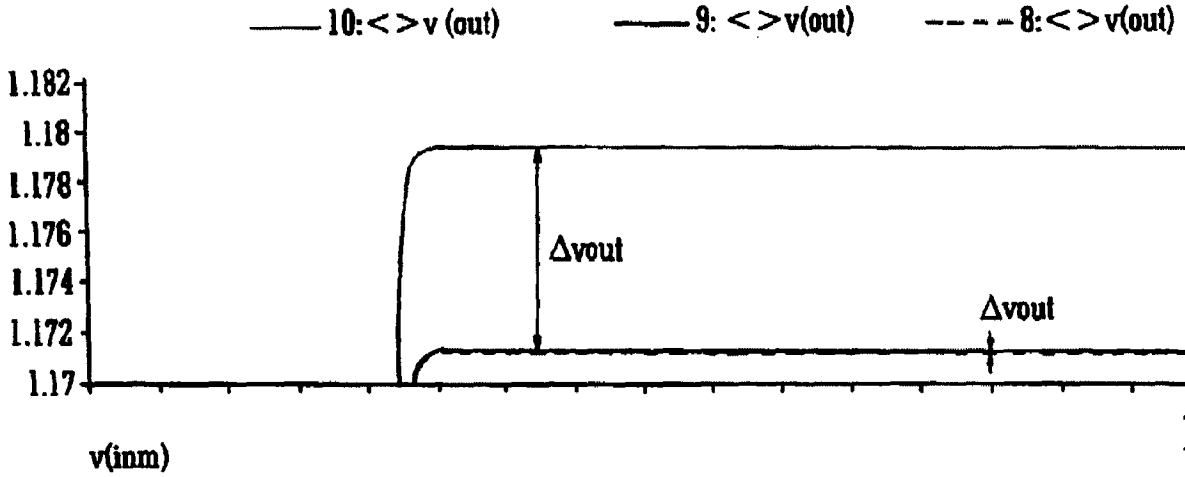
FIG. 5 is a simulation result showing the type of improvement that is achievable using the implementation of the present invention.
Figure 5B:
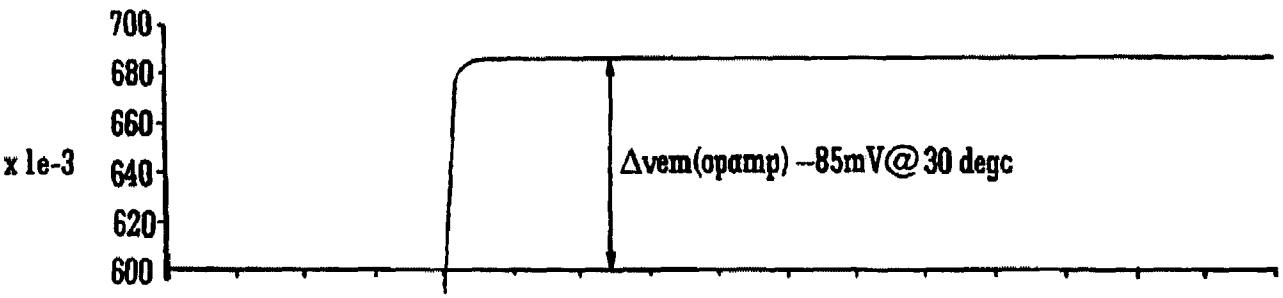

The performance of the circuit of FIG. 3 was simulated and the results are shown in FIG. 5. It will be appreciated that a reduction in the output change due to the parasitic capacitance Cp of about 50 times is achieved.

Figure 6:
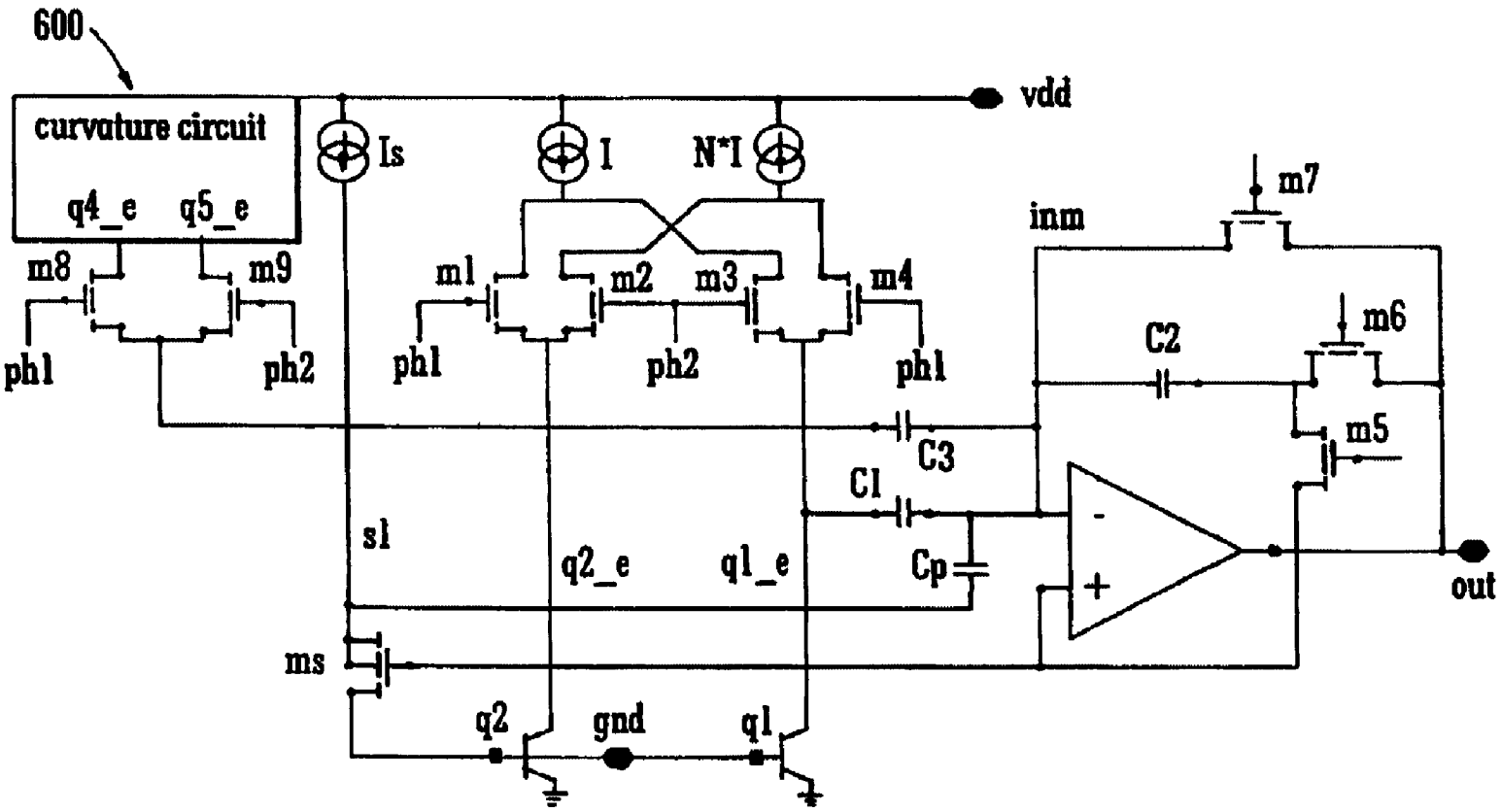
FIG. 6 shows a modification to the circuit of FIG. 3, including circuitry adapted to compensate for curvature in the output of the reference circuit.
Figure 7:
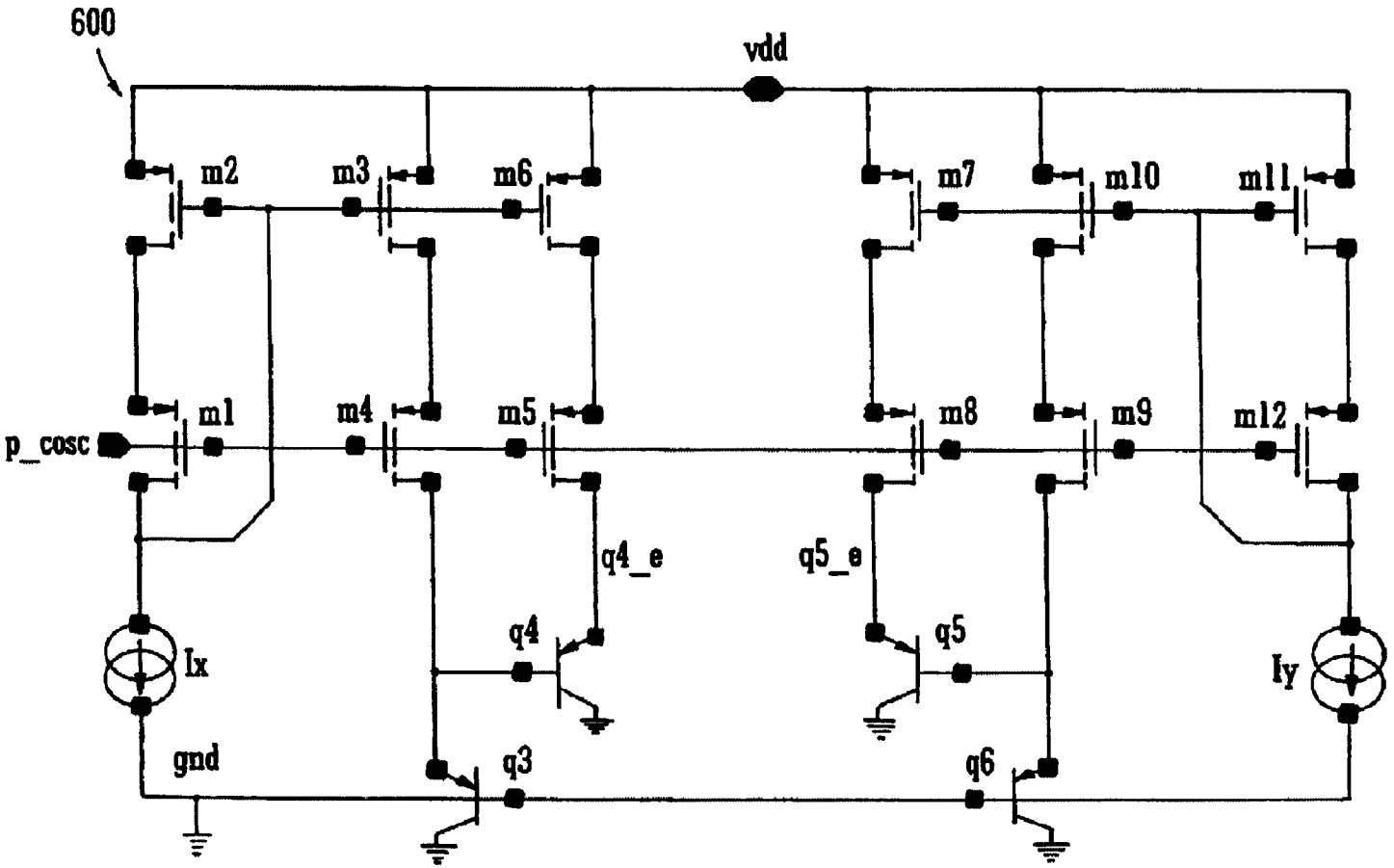
FIG. 7 is a detail of the curvature correction circuitry of FIG. 6.
Figure 8A:
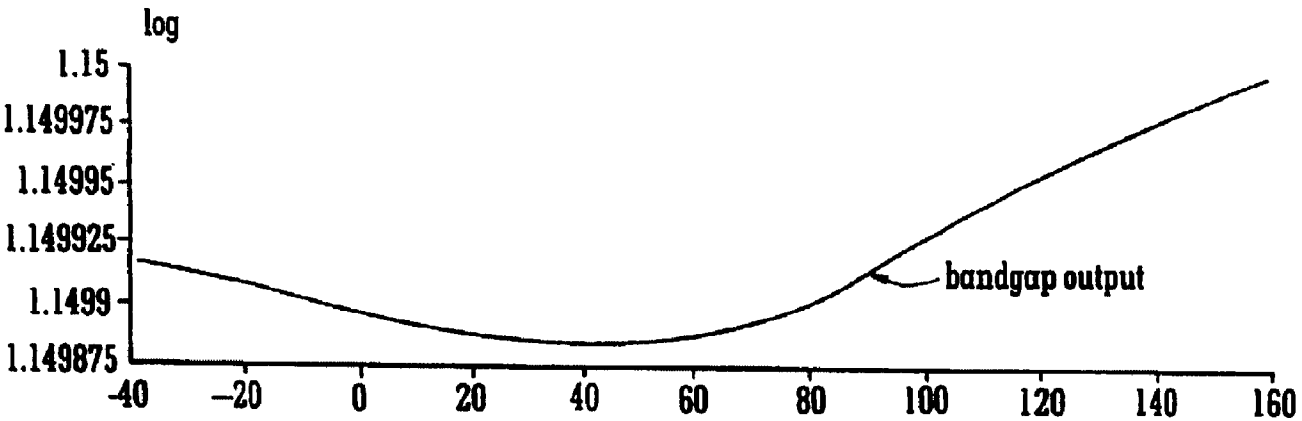
FIG. 8 is a simulation result showing examples of the output of the circuit of the present invention verse temperature.
Figure 8B:
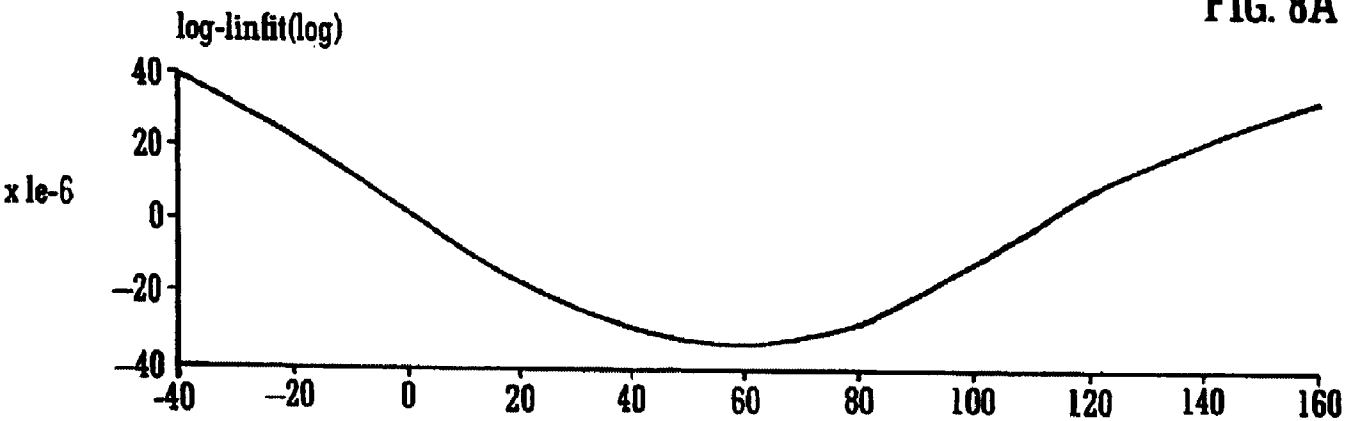
Figure 8C:
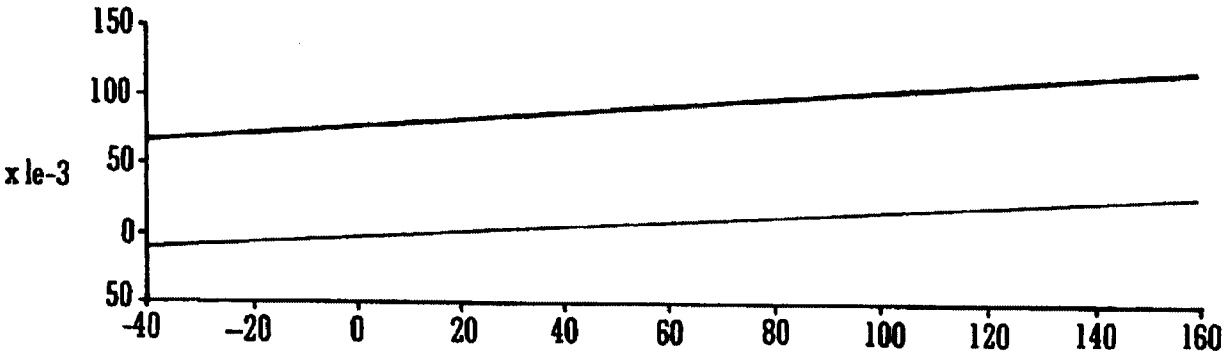
Figure 8D:
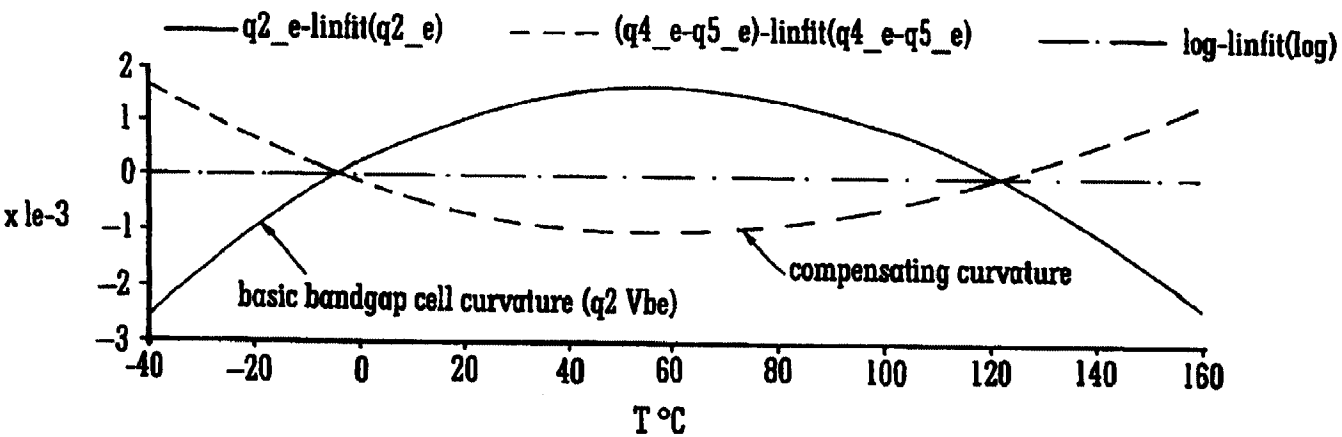

FIGS. 6 and 7 show circuitry that may be included with that of FIG. 3 so as to compensate for curvature in the output of the bandgap reference. An additional capacitor C3 is coupled to switches m8 and m9, which enables a selective switching of curvature correction components such as those shown in the curvature correction configuration of block 600 into the circuit of FIG. 3. Details of the block 600 are shown in FIG. 7 where it will be seen that pmos devices m2, m3 and m6 form a current mirror which mirrors the bias current Ix into the bipolar transistor stack q3 and q4. Additional MOS devices m1, m4, m5, m8, m9 and m12 are provided in a cascode arrangement so as to improve the performance of the mirror. The current Ix or Iy may be trimmed as necessary to improve the performance of the circuit.

If the operating currents of the bipolar transistors are chosen such that Ix is PTAT and Iy is CTAT then a compensating curvature, i.e., a TlnT term of opposite sign to the TlnT term generated as a second order feature of the base emitter voltage of q2, can be generated to effectively cancel the effect of the curvature introduced by q2. It will be appreciated that different flavours of the current mixture can be provided to produce varying amounts of curvature correction, and that this term can be scaled by the choice of the value of the capacitor C3.

The output voltage Vout of the circuit of FIG. 6 is given by:

$$Vout=Veb2(NI)+[C1/C2]*[\Delta Veb1+\Delta Veb2]+[C3/C2]*[\Delta Veb2+V(q4_e)-V(q5_e)] \quad (6)$$

Assuming that ΔVeb1=ΔVeb2=ΔVeb, then the output voltage, Vout, can be given by:

$$Vout=Veb2(NI)+\Delta Veb*[2*C1+C3]/C2+[C3/C2]*[V(q4_e)-V(q5_e)] \quad (7)$$

This curvature correction term is generated by taking the difference of the two base emitter voltages of q3/q4 and q5/q6 and scaling the voltage using the capacitor ratio C3/C2. It will be appreciated that by using a BJT stack the total capacitor area is minimized.

It will be understood that what has been described herein is a switched capacitor bandgap reference circuit which has improved characteristics and performance relative to the prior art. In a first embodiment a configuration has been shown whereby capacitors and interconnects between the capacitors are shielded and the shields are bootstrapped to a voltage driving circuit so as to minimise the effect of any parasitic capacitance within the circuit. In another embodiment, a prior art bandgap reference circuit is improved by incorporation of circuitry adapted to provided for curvature correction. Although the present invention has been described with reference to specific embodiments and figures it will be appreciated that components from one figure may be interchanged with those of other figures and it is not intended to limit the present invention to any one specific embodiment except as may be deemed necessary in the light of the appended claims.

The words comprises/comprising when used in this specification are to specify the presence of stated features, integers, steps or components but does not preclude the presence or addition of one or more other features, integers, steps, components or groups thereof.

The invention claimed is:

1. A switched capacitor bandgap reference circuit comprising:

a) a first transistor adapted to operate at a first current density so as to provide a first transistor output, b) a second transistor adapted to operate at a second current density so as to provide a second transistor output, c) a switched capacitor amplifier including a capacitor network, the amplifier providing an output based on the difference between the first and second transistor outputs, d) a capacitor shield adapted to shield said capacitor network, and e) a voltage driving circuit coupled to said capacitor shield, the voltage driving circuit being adapted to drive said shield to the voltage of one of the transistor outputs.

2. The circuit as claimed in claim 1 wherein the capacitor network includes at least two capacitors, a first capacitor coupled to an inverting input of the amplifier and a second capacitor provided in a feedback loop between the output of the amplifier and the inverting input.

3. The circuit as claimed in claim 2 wherein the first and second capacitors are provided with an interconnect therebetween, the circuit additionally comprising an interconnect shield adapted to shield said interconnect and wherein the interconnect shield is also coupled to a voltage driving circuit, the voltage driving circuit being adapted to drive said shield to the voltage of one of the transistor outputs.

4. The circuit as claimed in claim 3 wherein the driving circuit coupled to the interconnect shield and the driving circuit coupled to the capacitor shield are the same.

5. The circuit as claimed in claim 3 wherein the capacitor shield and the interconnect shield are provided by the same shield.

6. The circuit as claimed in claim 1 wherein the capacitors are provided by at least two layers in a multi-layer structure, the at least two layers being formed one above the other and being separated from one another and wherein the capacitor shield is formed as a layer above the upper layer of the capacitor structure.

7. The circuit as claimed in claim 3 wherein the interconnect is provided by a layer within a multi-layer structure.

8. The circuit as claimed in claim 7 wherein the interconnect layer is provided in a sandwich arrangement, being shielded above and below by layers of the multi-layer structure.

9. The circuit as claimed in claim 7 wherein one of the layers of the multi-layer structure is used to provide an interconnect layer, the interconnect layer being shielded above and below by other layers of the multi-layer structure.

10. The circuit as claimed in claim 9 wherein two or more layers are coupled to one another, thereby being provided at the same potential, these layers providing at least one of the capacitor shield or interconnect shield.

11. The circuit as claimed in claim 3 further including a switching device coupled to the second capacitor and provided in the feedback loop between the amplifier output and its inverting input.

12. The circuit as claimed in claim 11 wherein an interconnect between the second capacitor and the switching device is also shielded with the interconnect shield.

13. The circuit as claimed in claim 12 wherein the interconnect is provided by a layer within a multi-layer structure and the shield is provided by layers above and below the interconnect layer.

14. The circuit as claimed in claim 13 wherein at least one of the layers in the multi-layer structure is a metal layer.

15. The circuit as claimed in claim 13 wherein at least one of the layers in the multi-layer structure is formed from polysilicon material.

16. The circuit as claimed in claim 1 wherein the amplifier output is a combination of a proportional to absolute temperature (PTAT) voltage provided by the difference in base emitter voltages between the two transistors and a voltage provided by the base emitter voltage of one of the transistors.

17. The circuit as claimed in claim 16 wherein the capacitor network includes a first capacitor coupled to the negative input of the amplifier and a second capacitor provided in a feedback loop between the output of the amplifier and the negative input of the capacitor and the PTAT voltage is scaled by a value proportional to the ratio of the values of the first and second capacitors.

18. The circuit as claimed in claim 17 wherein the base emitter voltage of one of the transistors includes a second order TlnT term, the TlnT term contributing a curvature effect at the output of the amplifier and wherein the circuit further includes curvature correction components, the curvature correction components adapted to provide a complimentary TlnT voltage term which is superimposed at the output of the amplifier so as to compensate for any bow effect arising from the second order TlnT term of the base emitter voltage of one of the transistors.

19. The circuit as claimed in claim 18 wherein the curvature correction components are coupled to the inverting input of the amplifier.

20. The circuit as claimed in claim 19 wherein a third capacitor is provided, the third capacitor being provided in the path between the inverting input of the amplifier and the curvature correction components.

21. The circuit as claimed in claim 20 wherein an interconnect between the third capacitor and the inverting input is shielded, the shield being coupled to a voltage driving circuit, the voltage driving circuit being adapted to drive said shield to the voltage of one of the transistor outputs.

22. The circuit as claimed in claim 21 wherein the curvature correction components may be switchably coupled to the amplifier.

23. The circuit as claimed in claim 18 wherein the curvature correction components include a stacked transistor arrangement.

24. The circuit as claimed in claim 1 wherein the voltage driving circuit includes a transistor configured as a voltage follower, the transistor being coupled to a current source and ground, the gate of the transistor being coupled to one of the transistors operating at different current densities.

25. A switched capacitor bandgap reference circuit including an amplifier having a first capacitor coupled to its inverting input and a second capacitor provided in a feedback loop from the output to the inverting input, each of the capacitors being formed from a stack arrangement, the stack including first and second layers located one above the other and having a shield located thereabove, the circuit additionally including a first and a second bipolar transistor, the transistors adapted to operate at different current densities and being switchably coupled to the inverting and non-inverting inputs of the amplifier such that, in use, a switching operation effects the generation of a difference in base emitter voltage, ΔVeb, between the two transistors which when coupled to a base emitter voltage of the first transistor generates at the output of the amplifier a voltage reference, and wherein a voltage follower is additionally provided, the voltage follower being coupled to the shield of the capacitors and being further adapted to track voltage changes at the amplifier input, thereby bootstrapping the shield of the capacitors to the first transistor and minimizing the effect of parasitic capacitances.

26. The circuit as claimed in claim 25 wherein the voltage follower is a high impedance device.

27. The circuit as claimed in claim 25 wherein the voltage follower is provided as a MOSFET device.

28. A switched capacitor bandgap reference circuit including an amplifier having a first capacitor coupled to its inverting input and a second capacitor provided in a feedback loop from the output to the inverting input, the circuit additionally including a first and a second bipolar transistor, the transistors adapted to operate at different current densities and being switchably coupled to the inverting and non-inverting inputs of the amplifier such that, in use, a switching operation effects the generation of a difference in base emitter voltage, ΔVeb, between the two transistors which when coupled to a base emitter voltage of the first transistor generates at the output of the amplifier a voltage reference, the voltage reference being a combination of a proportional to absolute temperature (PTAT) voltage provided by the difference in base emitter voltages between the two transistors and a voltage provided by the base emitter voltage of the first transistor, the voltage provided by the base emitter voltage of the first transistor having first and second order contributions and wherein the circuit additionally comprises curvature correction components, the curvature correction components being coupled to the inverting input of the amplifier and adapted to provide a complimentary voltage to the second order contribution of the first transistor so as to compensate for any bow effect arising from the second order contribution.

29. The circuit as claimed in claim 28 wherein the ratio of the values of the first and second capacitors determines a scaling of the PTAT voltage.

30. The circuit as claimed in claim 28 wherein the curvature correction components are coupled to the inverting input via a third capacitor.

31. The circuit as claimed in claim 28 wherein the curvature correction components may be switchably coupled to the inverting input.

32. The circuit as claimed in claim 30 wherein each of the capacitors is formed in a multi-layer stack, the stack including first and second layers located one above the other and having a shield located thereabove.

33. The circuit as claimed in claim 32 additionally comprising a voltage follower, the voltage follower being coupled to the shield of the capacitors and being further adapted to track voltage changes at the amplifier input, thereby bootstrapping the shield of the capacitors to the first transistor and minimizing the effect of parasitic capacitances.

34. The circuit as claimed in claim 32 wherein an interconnect between the first, second and third capacitors is provided in a layer of the multi-layer stack, the interconnect being provided with a shield above and below the interconnect.

35. The circuit as claimed in claim 34 wherein the interconnect shield is additionally coupled to a voltage follower, the voltage follower being adapted to track voltage changes at the amplifier input, thereby bootstrapping the interconnect shield to the first transistor and minimizing the effect of parasitic capacitances.

36. The circuit as claimed in claim 28 wherein the curvature correction components include a plurality of transistors provided in a stack arrangement.

* * * * *